US008544688B2

(12) United States Patent
Ballentine

(10) Patent No.: US 8,544,688 B2
(45) Date of Patent: Oct. 1, 2013

(54) PERSONAL HYDRATION SYSTEM WITH CONTROL VALVE ASSEMBLY

(75) Inventor: Trent Ballentine, Normal, IL (US)

(73) Assignee: Simple Matter, Inc., Normal, IL (US)

( * ) Notice: Subject to any disclaimer, the term of this patent is extended or adjusted under 35 U.S.C. 154(b) by 749 days.

(21) Appl. No.: 12/701,304

(22) Filed: Feb. 5, 2010

(65) Prior Publication Data

US 2010/0213223 A1 Aug. 26, 2010

Related U.S. Application Data

(60) Provisional application No. 61/154,280, filed on Feb. 20, 2009.

(51) Int. Cl.
*B67D 7/78* (2010.01)

(52) U.S. Cl.
USPC ..... 222/145.5; 222/325; 222/502; 222/537; 222/547; 224/148.2; 604/85; 604/519

(58) Field of Classification Search
USPC ..... 604/82, 85, 518–519; 222/145.1–145.9, 222/325–327, 502–503, 537, 544–564; 224/148.2
See application file for complete search history.

(56) References Cited

U.S. PATENT DOCUMENTS

| | | | | |
|---|---|---|---|---|
| 1,365,183 | A * | 1/1921 | Moffatt | 604/85 |
| 2,620,107 | A | 12/1952 | Tolan | |
| 4,573,967 | A * | 3/1986 | Hargrove et al. | 604/85 |
| 4,668,219 | A * | 5/1987 | Israel | 604/85 |
| 4,681,244 | A * | 7/1987 | Geddie | 222/144.5 |
| 4,739,905 | A | 4/1988 | Nelson | |
| 4,815,635 | A | 3/1989 | Porter | |
| 4,820,269 | A * | 4/1989 | Riddell | 604/85 |
| 5,304,130 | A * | 4/1994 | Button et al. | 604/85 |
| 5,306,242 | A * | 4/1994 | Joyce et al. | 604/82 |
| 5,634,571 | A | 6/1997 | Cataneo et al. | |
| 6,749,090 | B2 | 6/2004 | Bailey | |
| 7,086,431 | B2 * | 8/2006 | D'Antonio et al. | 141/330 |
| 7,487,888 | B1 | 2/2009 | Pierre, Jr. | |
| 7,533,786 | B2 | 5/2009 | Woolfson et al. | |
| 7,784,651 | B2 * | 8/2010 | Batschied et al. | 222/484 |
| 2003/0075573 | A1 | 4/2003 | Bailey | |

(Continued)

FOREIGN PATENT DOCUMENTS

| | | | |
|---|---|---|---|
| WO | 2009077681 | A2 | 6/2009 |
| WO | 2009077682 | A2 | 6/2009 |

*Primary Examiner* — Paul R Durand
*Assistant Examiner* — Andrew P Bainbridge
(74) *Attorney, Agent, or Firm* — Andrus, Sceales, Starke & Sawall, LLP

(57) ABSTRACT

A personal hydration system includes a control valve assembly including a valve body provided with a first inlet port, a second inlet port, and an outlet port provided with a delivery hose for dispensing at least fluid from the hydration bladder. The control valve assembly further includes a non-collapsible reservoir which holds an additive and is directly mounted via a rigid connection to the second inlet port of the valve body. A supply hose is connected between the hydration bladder and the first inlet port of the valve body. A valve core is rotatably mounted in the valve body to establish at least either a single flow condition of the liquid or a mixed flow condition of the liquid and the additive. In the mixed flow condition, the liquid from the hydration bladder freely flows through the valve core and is admitted into and circulated through the reservoir to produce a mixture of liquid and additive deliverable to the outlet port.

19 Claims, 12 Drawing Sheets

(56) References Cited

U.S. PATENT DOCUMENTS

2004/0118942 A1* 6/2004 Courtney ..... 239/302
2004/0262331 A1 12/2004 Woolfson et al.
2007/0090135 A1 4/2007 Benham
2010/0065584 A1 3/2010 Berger

* cited by examiner

PERSONAL HYDRATION SYSTEM WITH CONTROL VALVE ASSEMBLY

CROSS REFERENCE TO RELATED APPLICATIONS

The present application relates to and claims priority from U.S. Provisional Patent Application Ser. No. 61/154,280, filed Feb. 20, 2009, which is fully incorporated herein by reference.

FIELD

The present disclosure relates generally to personal hydration systems and, more particularly, pertains to a personal hydration system equipped with a control valve assembly for selectively regulating the flow of various liquids desired by a user of the system.

SUMMARY

The present inventor has recognized deficiencies in prior art personal bladder-type hydration systems. For example, known control valve assemblies for personal hydration systems are often designed with collapsible additive reservoirs that are susceptible to rupture or deformation, which negatively affects the output of the liquid and/or additive mixture to the user. In addition, prior art control valve assemblies that utilize check valves to ensure one-way flow of liquids in the personal hydration system can become plugged inhibiting flow behavior and restricting the control valve to using additives of limited nature and viscosity.

The inventor has recognized that it is desirable to provide a personal hydration system which overcomes the drawbacks of the prior art, and includes a control or mixing valve that selectively controls dispensing of a liquid, such as water or juice, alone or in combination with an additive in solid or liquid form.

In one example disclosed herein, a control valve assembly includes a valve body provided with a first inlet port in communication with the liquid in the hydration bladder, a second inlet port and an outlet port for dispensing at least the liquid from the hydration bladder therefrom. A control valve assembly has a reservoir holding an additive and is directly mounted to the second inlet port of the valve body such that the additive is in communication with the second inlet port. The control valve assembly also includes a valve core rotatably mounted within the valve body to establish at least either a single flow condition of the liquid or a mixed flow condition of the liquid and the additive. The valve body and valve core cooperatively define a liquid circulation arrangement directing flow from the hydration bladder into the reservoir to enable circulation and form a mixture of the liquid and additive in the reservoir deliverable to the outlet port.

In another example, a control valve assembly includes a valve body provided with a first inlet port, a second inlet port and an outlet port provided with a delivery hose for dispensing at least the liquid from the hydration bladder therefrom. The control valve assembly has a non-collapsible reservoir which holds an additive and is directly mounted via a rigid connection to the second inlet port of the valve body such that the additive is in communication with the second inlet port, and the reservoir extends from the valve body at a substantially 90° orientation thereto. A supply hose is connected between the hydration bladder and the first inlet port of the valve body such that the liquid is in communication with the first inlet port. The control valve assembly also includes a valve core rotatably mounted within the valve body to establish at least either a single flow condition of the liquid or a mixed flow condition of the liquid and additive. In the mixed flow condition, liquid from the hydration bladder flows freely through the valve core and is admitted into and circulated through the reservoir to produce a mixture of liquid and additive deliverable to the outlet port and the delivery hose.

In another example, a control valve assembly is adapted for use with a personal hydration system having a hydration bladder holding a liquid and provided with a supply hose in communication with the liquid. The control valve assembly includes a tubular valve body having a first inlet port adapted to be connected to the supply hose, a second inlet port extending from the valve body, the second inlet port being directly and rigidly mounted to a non-collapsible reservoir holding an additive thereon such that the additive, as well as liquid from the hydration bladder, is permitted to flow through the second inlet port, and an outlet port adapted to be connected to a delivery hose for dispensing at least liquid from the hydration bladder. A valve core is movably mounted within the valve body and has liquid passageways cooperable with the first and second inlet ports and the outlet port to establish at least either a single flow condition of the liquid or a mixed flow condition of the liquid and the additive deliverable to the output port and delivery hose. In the mixed flow condition, the valve core enables liquid from the hydration bladder to flow freely through the first and second inlet ports and be admitted into and circulated through the reservoir to produce a mixture of liquid and additive deliverable through the second inlet port to the outlet port and the delivery hose.

In another example, a kit is adapted to be used to control fluid flow in a personal hydration system having a hydration bladder filled with a liquid supported by straps upon a body of a user and provided with a supply hose in communication with the liquid. The kit includes a non-collapsible reservoir for holding an additive thereon. A control valve assembly includes a tubular valve body having a first inlet port adapted to be connected to a supply hose, a second inlet port defining a flow connection for directly and rigidly mounting the reservoir thereto such that the additive and the liquid from the hydration bladder is selectively permitted to flow into and out of the second inlet port, and an outlet port adapted to be connected to a delivery hose for dispensing at least the liquid from the hydration bladder. The control valve assembly also includes a valve core movably mounted in the valve body and having liquid passageways cooperable with the first and second inlet ports and the outlet port. The valve core is adapted to establish at least either a single flow condition of the fluid or mixed flow condition of the liquid and the additive. An attachment arrangement is adapted to connect at least one of the control valve assembly and the reservoir to the straps supporting the hydration bladder.

BRIEF DESCRIPTION OF THE DRAWINGS

The drawings illustrate the best mode presently contemplated under 35 U.S.C. §112.

DETAILED DESCRIPTION

Figure 1:
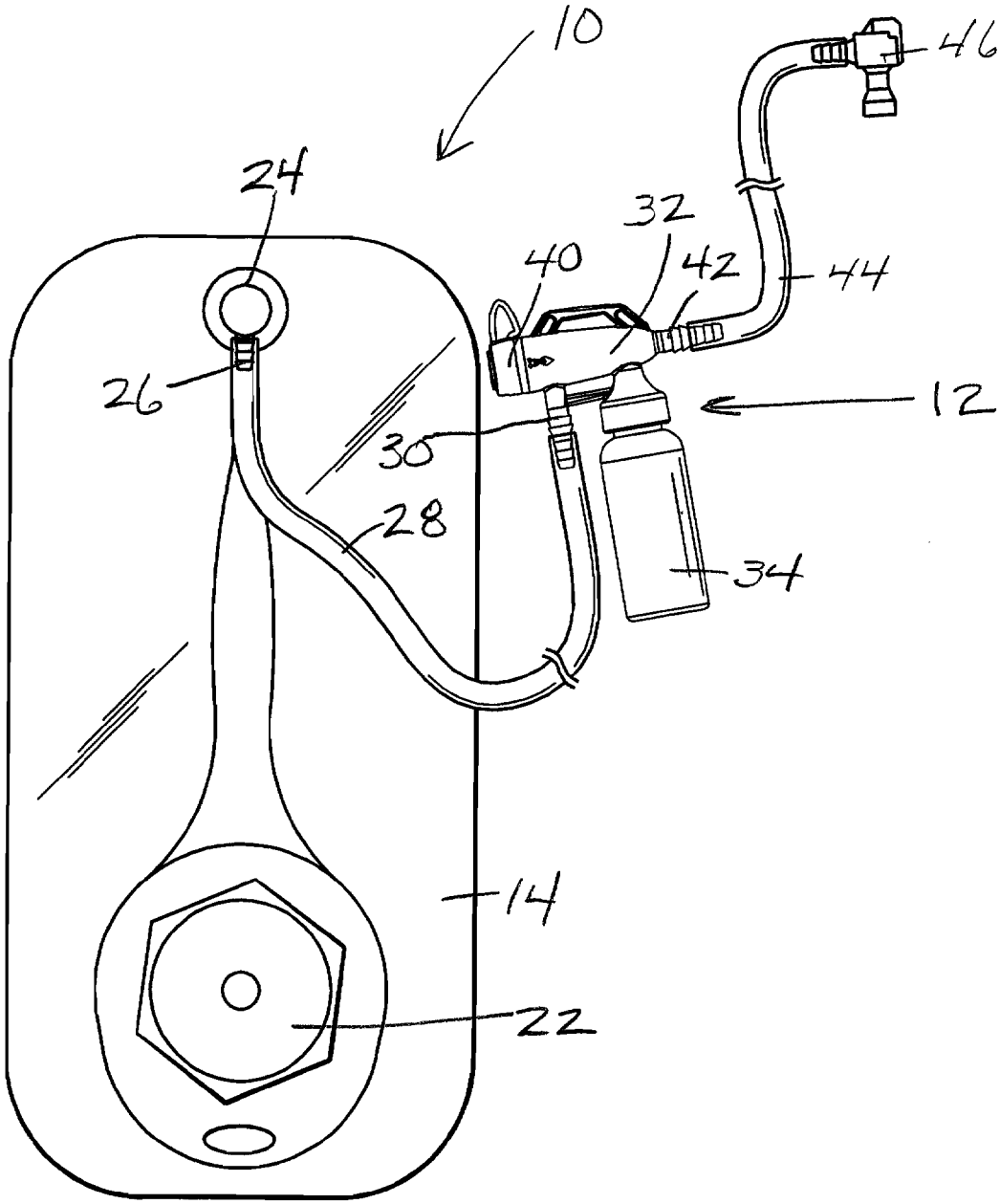
FIG. 1 is a plan view of a personal hydration system including one embodiment of a control valve assembly.

Referring now to the drawings, FIG. 1 illustrates a personal hydration system 10 for storing liquid (such as water, sports drinks, juices, etc.) and features a control valve assembly 12 for selectively controlling the flow of liquid from the system 10.

Figure 5:
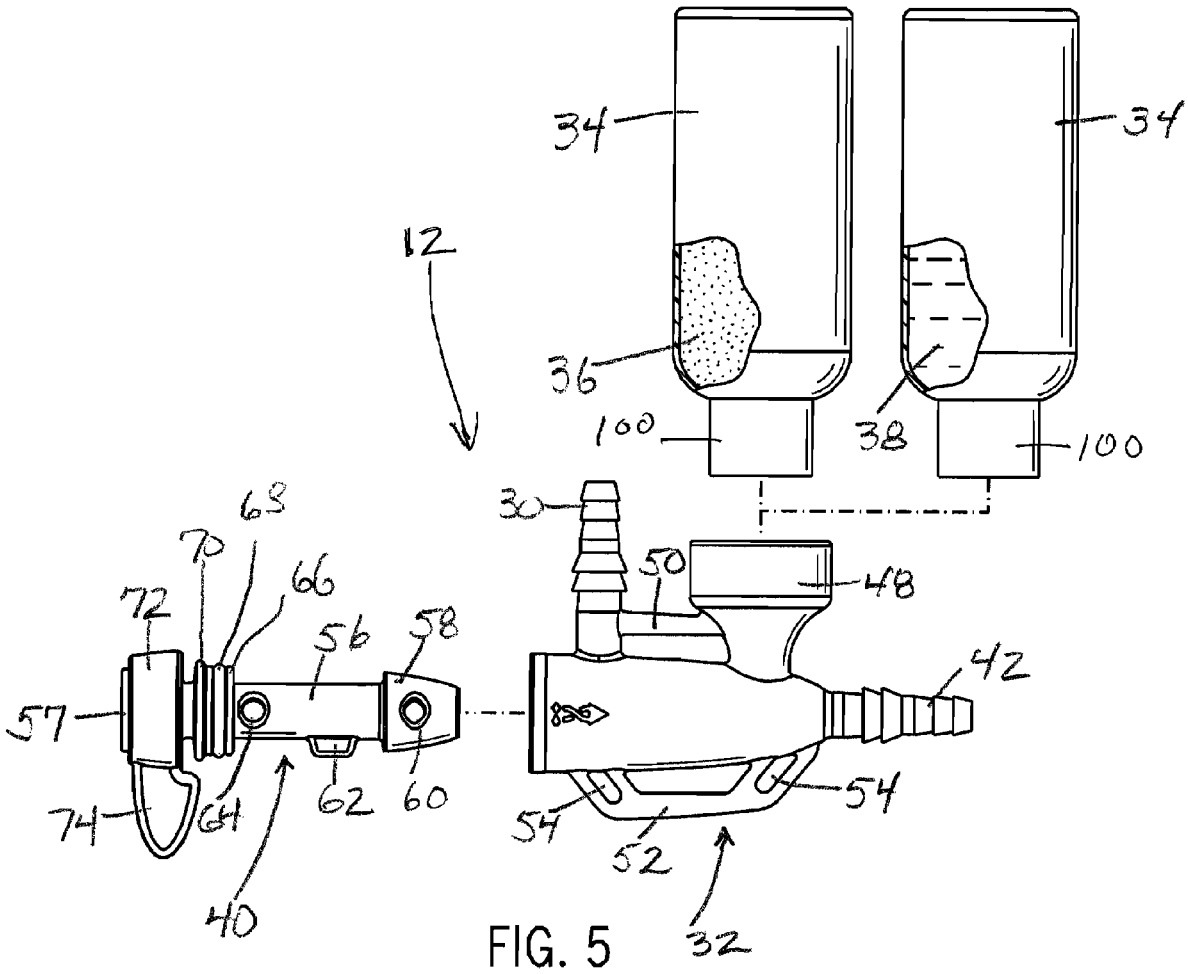
FIG. 5 is an exploded perspective view of the control valve assembly including a reservoir holding an additive as shown in FIG. 1.

Personal hydration system 10 includes a flexible and expandable bladder 14 which is typically housed in a carrying device 16 (FIG. 3) that is conveniently worn on the back of a user U and supported by shoulder straps 18 and a cross strap 20. The bladder 14 is provided with a fill opening having a cap 22, which may be opened and closed to fill, empty or clean the bladder 14. Bladder 14 also has an outlet 24 equipped with a first tubular barbed adapter 26 onto which one end of a typically transparent, flexible supply hose 28 is removably mounted. The other end of supply hose 28 is removably secured to a second barbed tubular adapter 30 extending generally perpendicularly from a tubular body 32 of the control valve assembly 12. A reservoir 34 taking the form of a non-collapsible, generally rigid and refillable plastic bottle is removably secured to the valve body 32 and is designed to hold an additive typically used to provide an energy and/or nutritional boost to the user of the hydration system 10. Such additive is typically in the form of a powder as shown at 36 (FIG. 5) or a gel 38 (FIG. 5). Many different sources and brands of powder, liquid and gel additives may be used in the reservoir 34.

The valve body 32 has an open end and is designed to receive a removable and rotatable valve control member or core 40. The valve body 32 also has a third barbed tubular adapter 42 which is removably attached to one end of a normally transparent delivery hose 44 at a forward end thereof. The delivery hose 44 forms a drinking tube to enable fluid to be withdrawn from bladder 14. The other end of the delivery hose 44 is provided with a bite or mouth-actuated valve 46. The bite valve 46 is selectively deformed from a position in which liquid regulated by control valve assembly 12 is prevented from being dispensed to a dispensing position in which the user U by oral suction may draw liquid from the bladder 14 when the user U compresses the mouth piece 46 with one's teeth or lips.

Referring now FIG. 5, the valve body 32 is provided with a reservoir receiver 48 spaced from the tubular adapter 30 for receiving and removably mounting the reservoir 34 at a substantially 90° orientation with respect to the valve body 32. A solid bar 50 interconnects tubular adapter 30 and reservoir receiver 48, and may be utilized with an appropriate attachment device such as a clip or tie to position the control valve assembly 12 on the straps 18 of the carrying device 16 holding the hydration bladder 14. In addition, the valve body 32 is formed with a retaining arm 52 opposite the adapter 30 and reservoir receiver 48. The retaining arm 52 creates one or more openings 54 for receiving an attachment device similarly used to fasten the control valve assembly 12 on the carrier straps 18 as will be further described below.

The valve core 40 as seen in FIG. 5, has an elongated tubular spool portion 56 provided with a bulbous front end 58 that is generally frustonically shaped and formed transversely therethrough with a first valve core port 60. Rearwardly of the front end 58, the spool portion 58 is formed with a tab 62 extending therefrom and includes a second valve core port 64 formed transversely therethrough. The spool portion 56 is also constructed with a grooved seal holder 66 that extends radially outwardly from an outer surface of the spool portion 56, and retains a sealing device such as an O-ring 68 thereon. A valve core retaining element 70 further extends radially from the spool portion 56, and has an outer diameter larger than that of the seal holder 66 to further retain O-ring 68 in position on a valve core 40. A cap 72 is integrally configured with a handle 74 and defines a rearward end of the spool portion 56.

Figure 9:
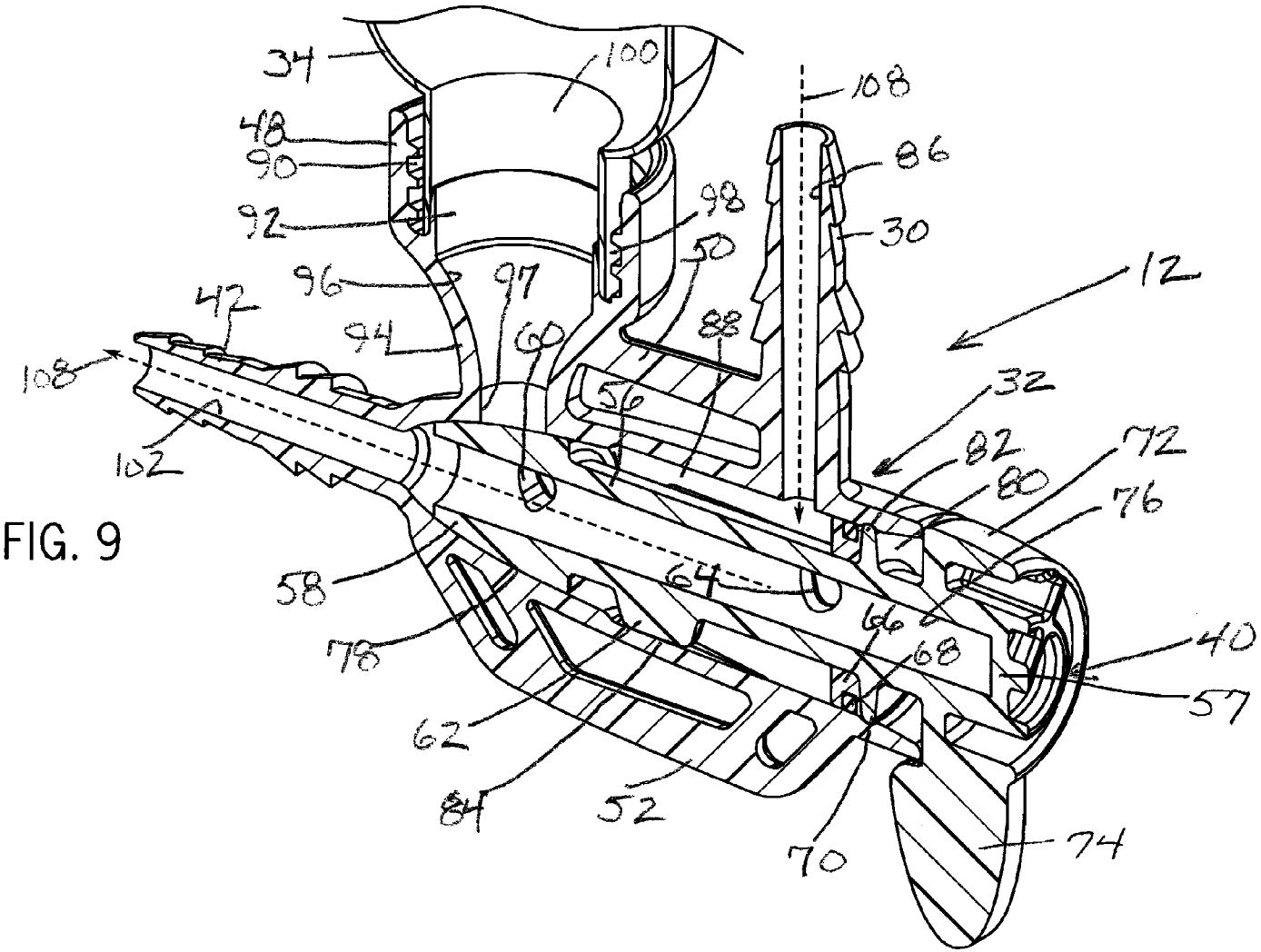
FIG. 9 is a longitudinal sectional view of the control valve assembly and reservoir of FIG. 1 in the single flow condition allowing only liquid flow.
Figure 10:
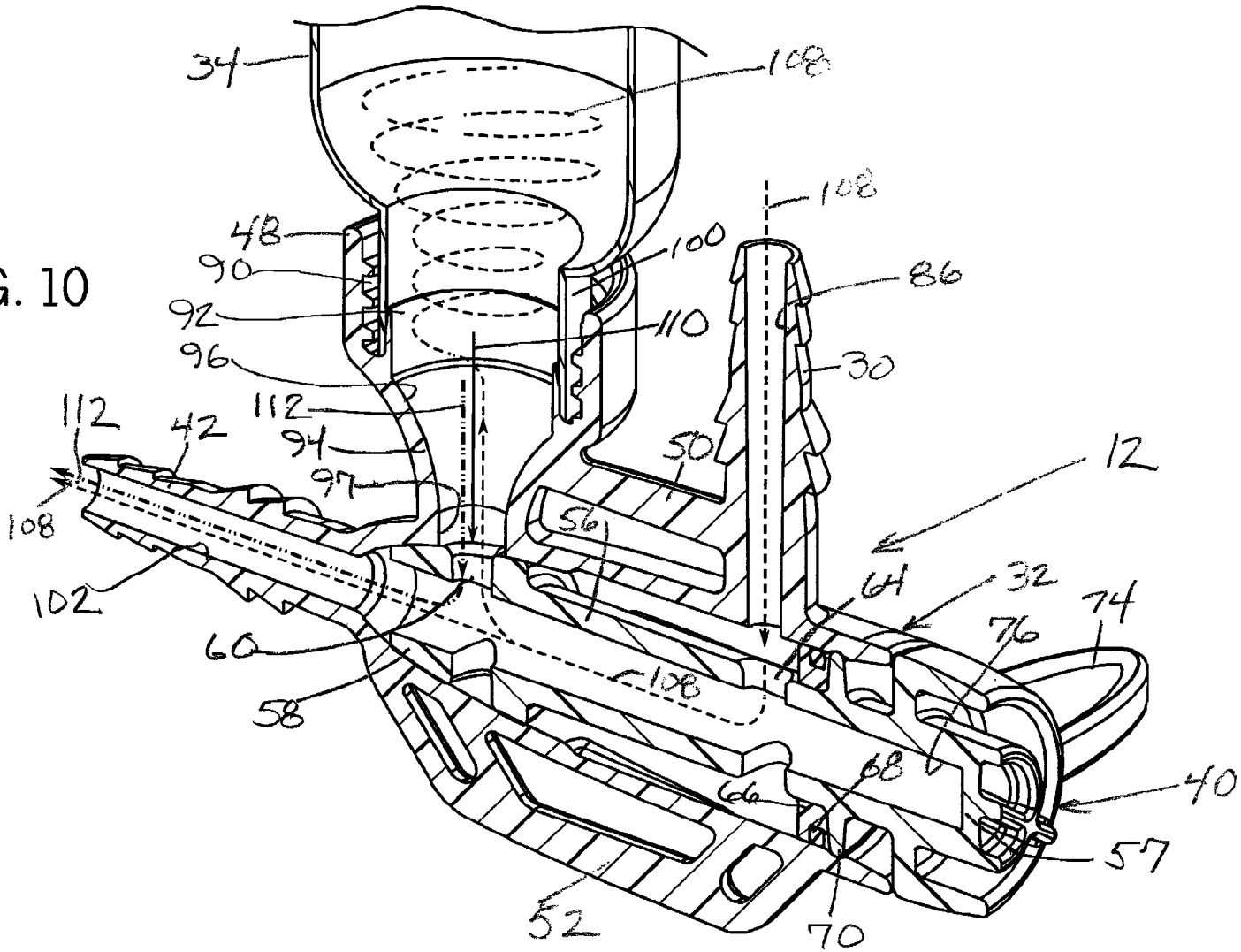
FIG. 10 is a longitudinal sectional view of the control valve assembly and reservoir of FIG. 1 in the mixed flow condition allowing a mixture of liquid and additive flow.
Figure 11:
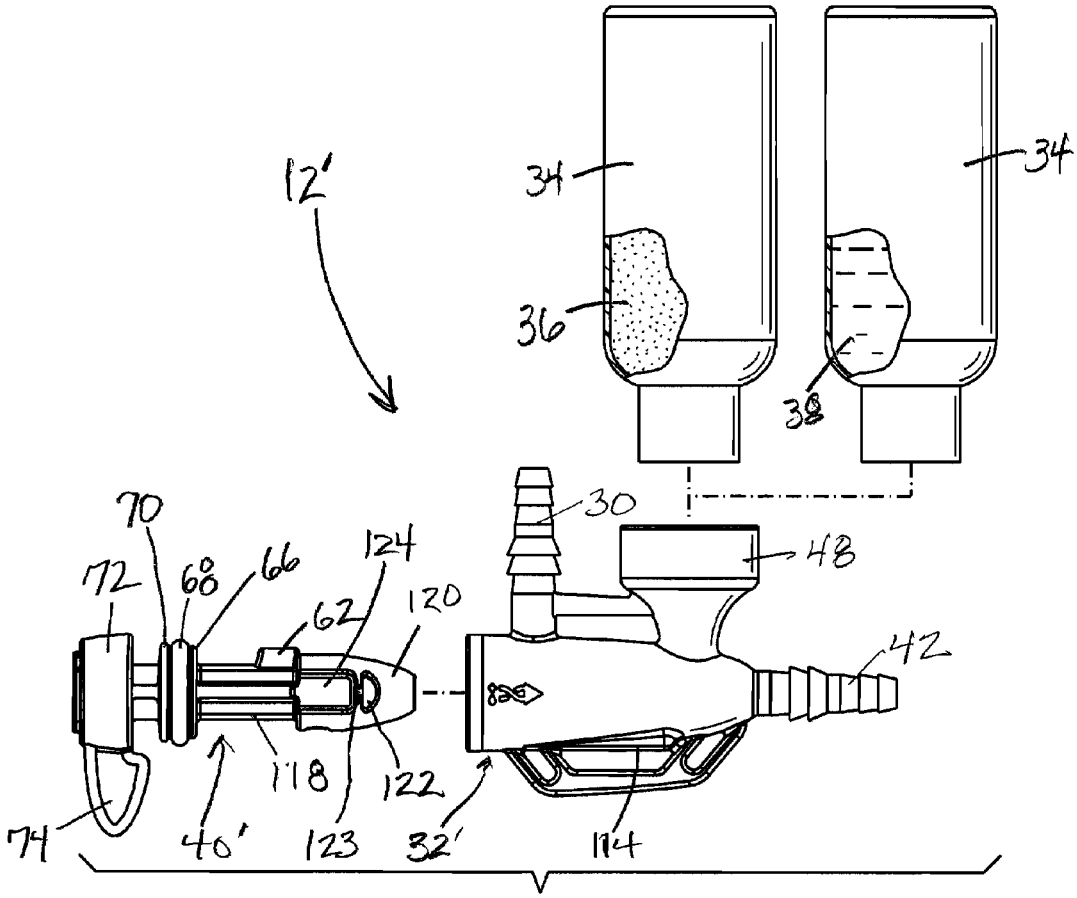
FIG. 11 is a view similar to FIG. 5 showing another embodiment of the control valve assembly.
Figure 12:
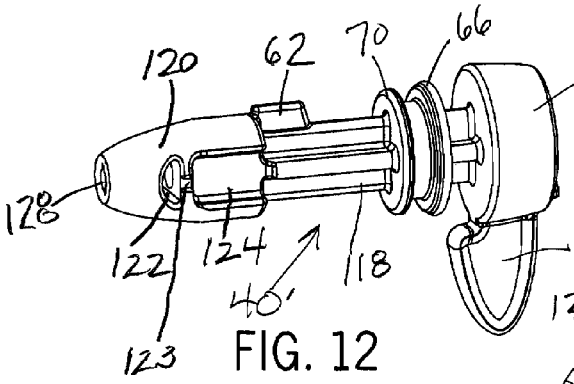
FIG. 12 is a perspective view of a valve core used in the control valve assembly of FIG. 11.
Figure 13:
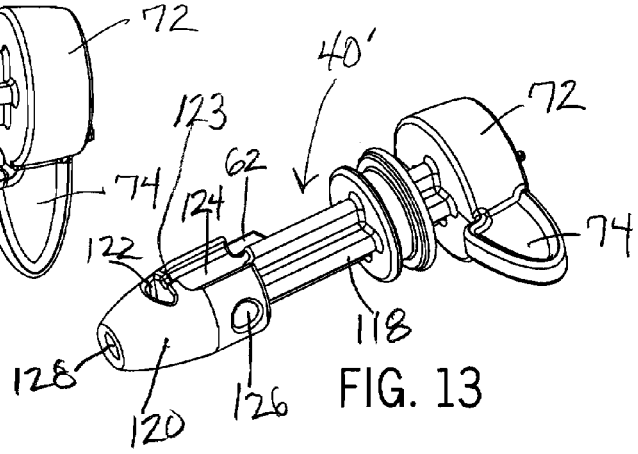
FIG. 13 is a view similar to FIG. 12 showing the valve core rotated 90°.

Referring to FIGS. 5, 9 and 10, the spool portion 56 has an internal chamber 76 extending longitudinally therethrough. The chamber 76 is closed at a rearward end 57 thereof, open at a forward end 58 thereof, and communicates with the valve core ports 60 and 64. The valve core ports 60 and 64 and the chamber 76 collectively define liquid passageways for selectively conducting liquid flow through the control valve assembly 12 as will be more closely understood hereafter.

Figure 8:
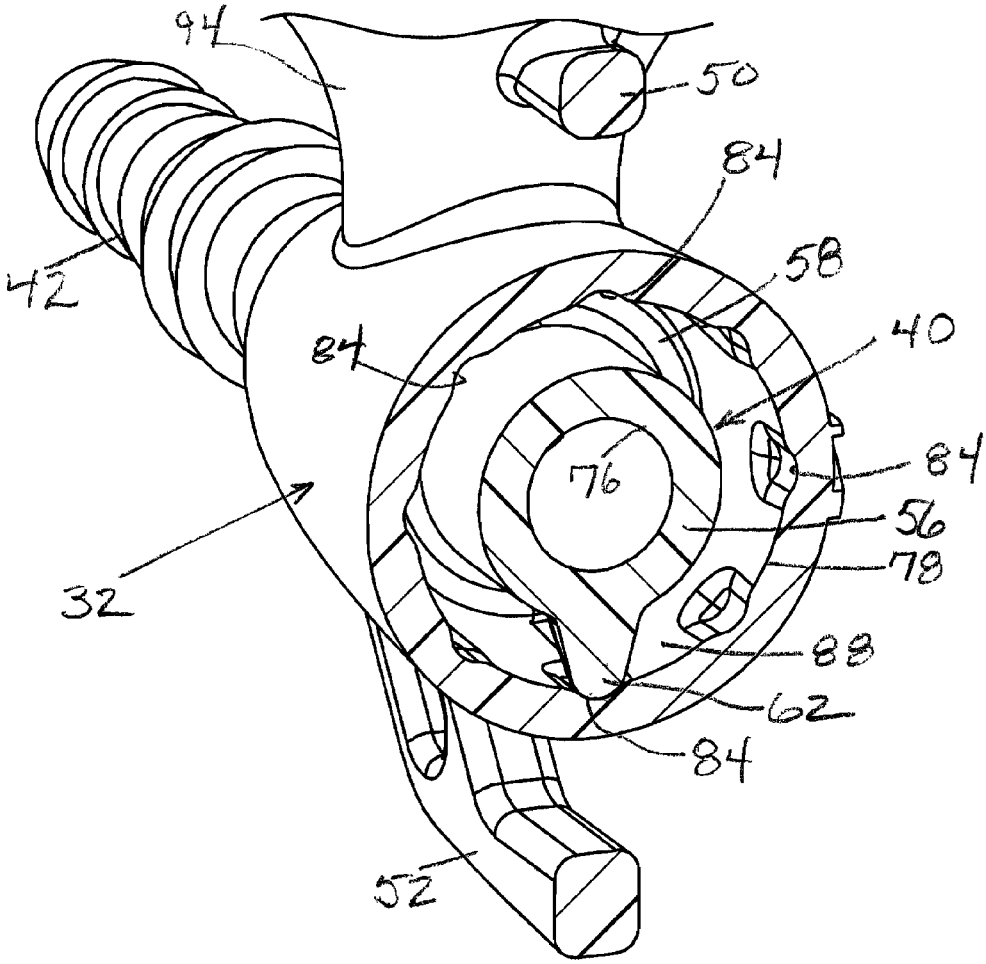
FIG. 8 is a cross sectional view of a tab and dimple arrangement provided between a valve core and a valve body of the control valve assembly of FIG. 1.

The valve body 32 is formed with an internal wall 78 defining a bore 80 and having a annular groove 82 for slidably receiving and retaining the valve core 40. Sliding of the valve core 40 into the bore 80 enables the retaining element 70 to snap into the wall 78 so as to permit rotation of the valve core 40, but prevent axial movement of the valve core port 60 relative to the valve body 32. At the same time, the O-ring 68 seals tightly against the internal wall 78 of the valve body 32. As seen best in FIG. 8, the internal wall 78 is formed with a series of spaced apart dimples 84 each of which is engageable with the tab 62 on the rotatable valve core 40 to precisely position the handle 74 relative to the valve body 32. The dimples 84 and the tabs 62 serve as a tactile indicator for selection of incremental positions of the rotatable valve core 40 within the valve body 32.

The tubular adapter 30 defines a first inlet port 86 which lies in communication with the water or other liquid in hydration bladder 14. The inlet port 86 also communicates with an axially extending recess 88 lying between the internal wall 78 of the valve body 32 and the outer surface of spool portion 56, and substantially surrounding the spool portion 56 between the front end 58 thereof and the seal holder 66. The reservoir receiver 48 has an internally threaded mouth 90, a sealing ring 92, and a narrowed portion 94 which defines a second inlet port 96. The narrowed portion 94 is provided with an opening 97 which is selectively aligned with the valve core port 60. External threads 98 on a neck 100 of the reservoir 34 are screwthreaded into the threaded mouth 90 such that an inner surface of the neck 100 is sealed with ring 92. With this construction, additive 36 or 38 in the reservoir 34 communicates with the second inlet port 96 which, in turn, may be placed in communication with valve core ports 60, 64 and chamber 76 upon selective rotation of the valve core 40. The tubular adapter 42 defines an outlet port 102 that provides communication between the chamber 76 and the delivery hose 44 terminating in bite valve 46. The outlet port 102 extends centrally from a forward end of the valve body 32, and is aligned with the chamber 76. A longitudinal axis of the control valve assembly 12 passes through the chamber 76 and outlet port 42. As will be described below, the valve core 40 is rotated within the bore 80 of the valve body 32 to create single flow and mixed flow conditions which will prevent or allow certain flow of liquid from the control valve assembly 12 to delivery hose 44 and bite valve 46.

The control valve assembly 12 is conveniently provided to the user U in the form of a kit or package which includes the valve core 40 assembled in the valve body 32 along with a reservoir 34 which is screwthreadedly attached to the valve body 32 and may be prefilled with liquid, gel or other additives 36 or 38, or may be manually filled by the user. The kit also includes attachment devices such as a tie 104 or band 106 for securing the control valve assembly 12 to the straps 18 of the carrier 16. Other suitable attachment devices may be provided to secure the control valve assembly 12 to the straps 18 of the carrier 16 holding the hydration bladder 14.

Figure 2:
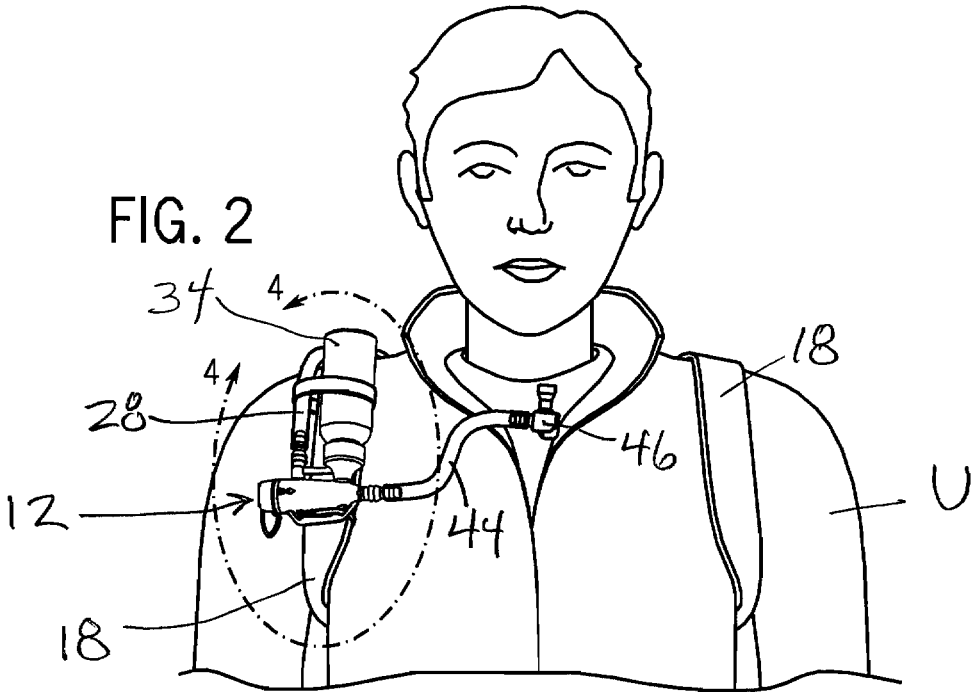
FIGS. 2-4 are exemplary views of the personal hydration system and the control valve assembly of FIG. 1 mounted upon a user.
Figure 3:
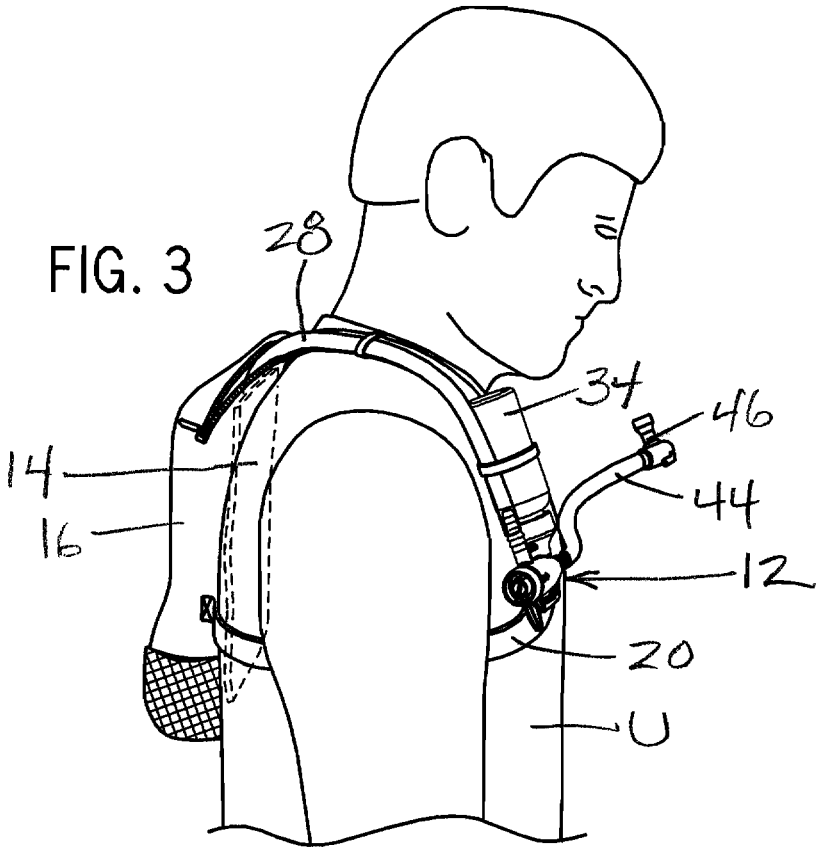
Figure 4:
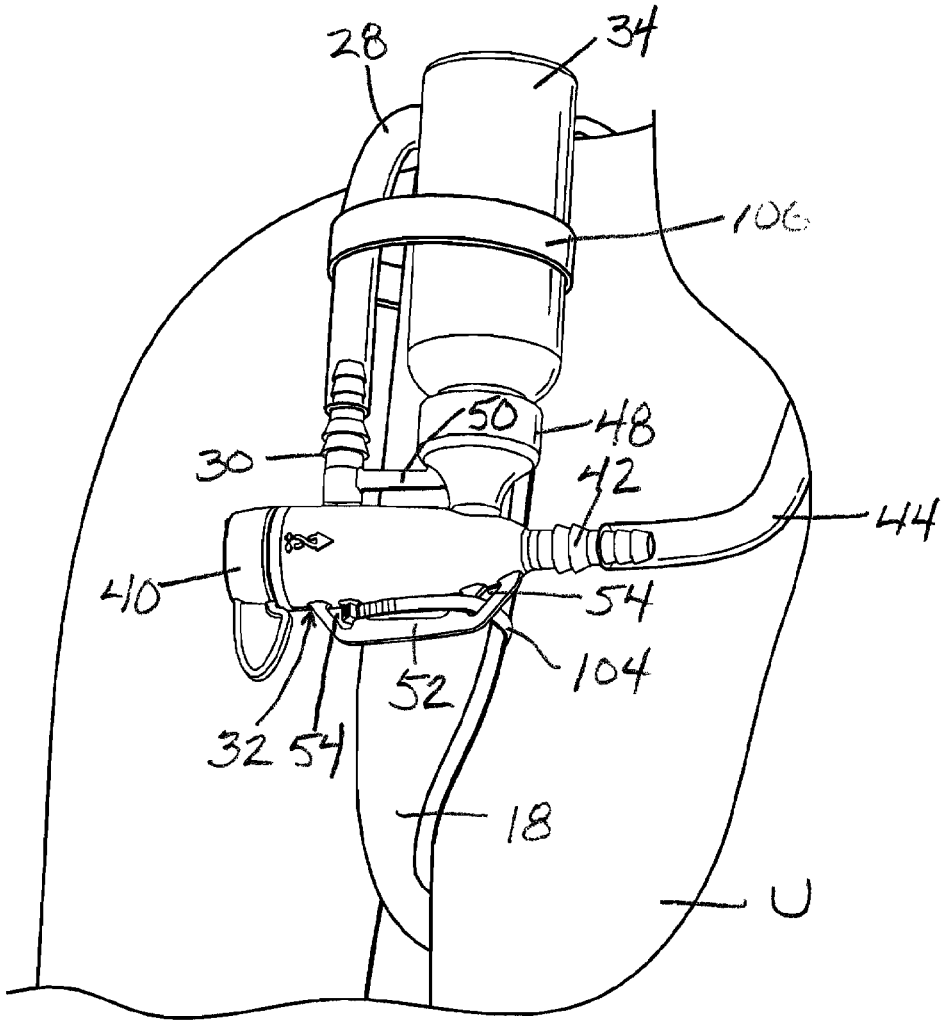

In an exemplary attachment shown in FIGS. 2-4, the tie 104 is passed through openings 54 on retainer arm 52 and secured to one of the over the shoulder straps 18. The band 106 secures the reservoir 34 and the supply hose 28 to the strap 18. In the exemplary attachment shown, the control valve assembly 12 is oriented such that the reservoir 34 filled with additive 36 or 38 is oriented in a generally gravity flow position when the user is in a generally upright position as is the case in a running, walking or biking activity. However, it should be understood that the control valve assembly 12 can also be used if the user U occupies a non-upright position, such as a prone position, as might be assumed during use by military personnel.

Figure 6:
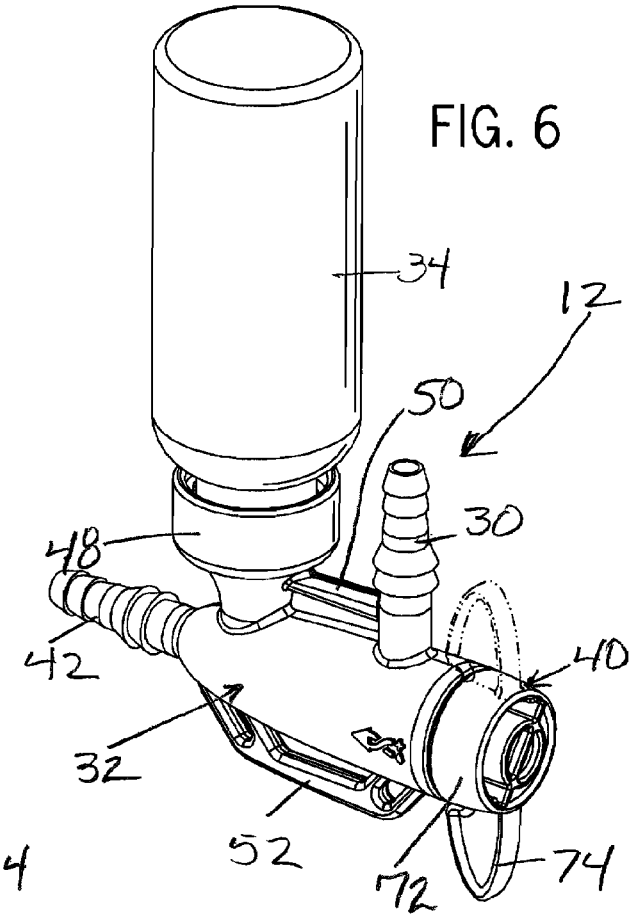
FIG. 6 is a perspective view of the assembled control valve assembly with the reservoir shown in FIG. 5 in a single flow condition to provide the user with a liquid only.

In operation, the valve core 40 is rotatably positioned within the valve body 32 in a single flow condition when the handle 74 is turned to the downwardly extending position shown in FIGS. 4 and 9, or an alternative upwardly extending position shown in phantom lines in FIG. 6. In the single flow condition, alignment of the second inlet port 96 with the valve core port 60 is blocked, but communication among first inlet port 86, valve core port 64, chamber 76 and outlet port 102 is enabled. As a result, no mixing of water or liquid from hydration bladder 14 and additive 36 or 38 in reservoir 34 is permitted, and liquid from hydration bladder 14 only is allowed to flow (as represented by the dotted line 108) through inlet port 86 to outlet port 102 and delivery hose 44 upon a suction force applied at bite valve 46.

It should be appreciated that leakage from the rear of the control valve assembly 12 is prevented by the O-ring 68. Leakage from the forward end of the control valve assembly 12 is prevented by the sealing interface between the bulbous front end 58 of the spool portion 56 and the internal wall 78 of the valve body 32.

Figure 7:
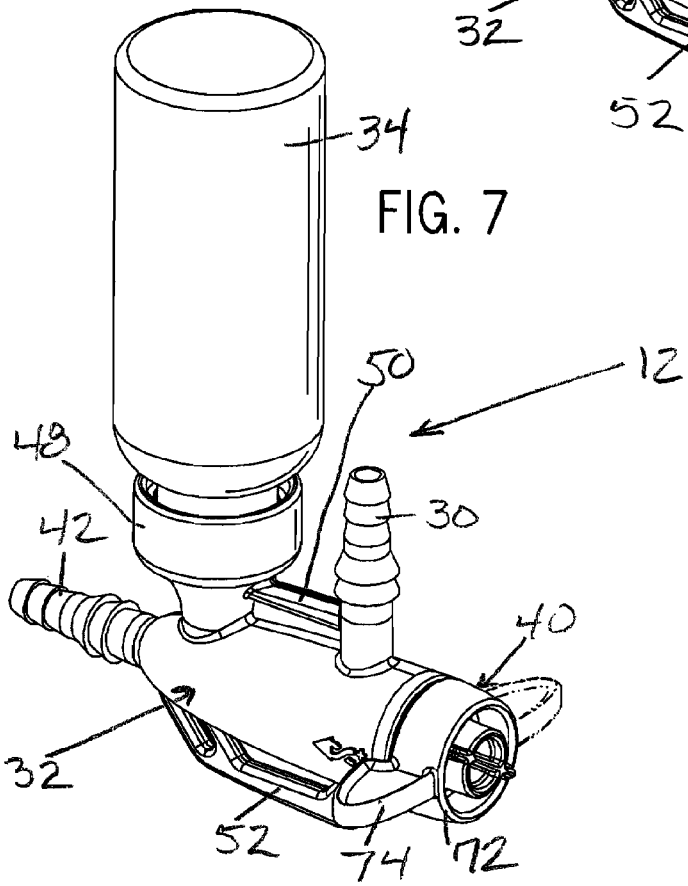
FIG. 7 is a perspective view of the assembled control valve assembly with the reservoir shown in FIG. 5 in a mixed flow condition to provide an additive mixed with the liquid.

The valve core 40 is rotatably positioned within the valve body 32 in a mixed flow condition when the handle 74 is turned to a laterally extending position shown in FIGS. 7 and 10, or an alternative position shown in phantom lines of FIG. 7. In the mixed flow condition, there is alignment of the second inlet port 96 with the valve core port 60 and simultaneous communication with the chamber 76, the valve core port 64, the first inlet port 86, and the outlet port 102. As a result, liquid from the hydration bladder 14 flows freely through the chamber 76 and directly into opening 97, second inlet port 96 and the reservoir 34, as represented by the dotted line 108, where it forcefully circulates and combines with the additive 36 or 38 represented by the solid line 110. Narrowed portion 94 serves as a flow directing structure for directing liquid flow from hydration bladder 14 into reservoir 34 to facilitate circulation of liquid and additive in the reservoir 34. The valve core port 60, the opening 97 and the narrowed portion 94 are sized and shaped to promote optimum flow of liquid 108 into the reservoir 34 so as to produce an evenly blended liquid mixture 112 of liquid 108 and additive 110 (as represented by line 112) to flow from the outlet port 42. That is, the circulation action of the liquid 108 and the additive 36 or 38 results in a more homogenous liquid mixture 112 which minimizes the presence of liquefied powder clumps when using a dry additive or globs when using a liquid or gel additive. The control valve assembly 12 has been found to provide a substantially consistent liquid mixture product when used with different types of powder, liquid and gel additives.

The control valve assembly 12 is suitably designed so that rotation of the valve core 40 within the valve body 32 between the single flow condition and the mixed flow condition shown in FIGS. 9 and 10 provides the user U with different ratios of liquid from the hydration bladder 14 and gel or powder additive 36 or 38 from the reservoir 34 as desired. The various ratios desired can be correlated with locations of the dimples 84 spaced circumferentially on the internal wall 78 of the valve body 32. Once the additive 36 or 38 is exhausted, the user U unscrews the reservoir 34 from the valve body 34, cleans the interior of the reservoir 34 and refills the reservoir 34 with a similar or different additive than previously used.

It should be appreciated that the control valve 12 does not utilize any check valves in the flow passageways 60, 64, 76 or inlet ports 86, 96, but instead provides a free flow of water or other liquid flow from the hydration bladder 14 (via a suction force) through the port 60 and opening 97 and into reservoir 34 so as to provide the circulation action with the additive 36 or 38 as described above. In addition, the circulation action is facilitated due to the substantially rigid, non-collapsible nature of the reservoir 34 which has an interior mixing space in which water or liquid sucked from the hydration bladder 14 replaces the additive 36 or 38 being mixed or diluted when the valve core 40 is in the mixing position. The control valve assembly 12 can provide a closed system wherein the reservoir 34 does not collapse, and enables circulation action for consistently dissolving a powder additive or liquefying a gel additive. The reservoir 34 can be constructed of substantially rigid material, such as plastic, which will not normally rupture or deform, such as by squeezing or pinching, so as to obstruct or destroy liquid flow.

FIGS. 11-16 illustrate another embodiment of a control valve assembly 12' which is generally similar to the control valve assembly 12 of FIGS. 1-10 except for the following modifications.

Figure 14:
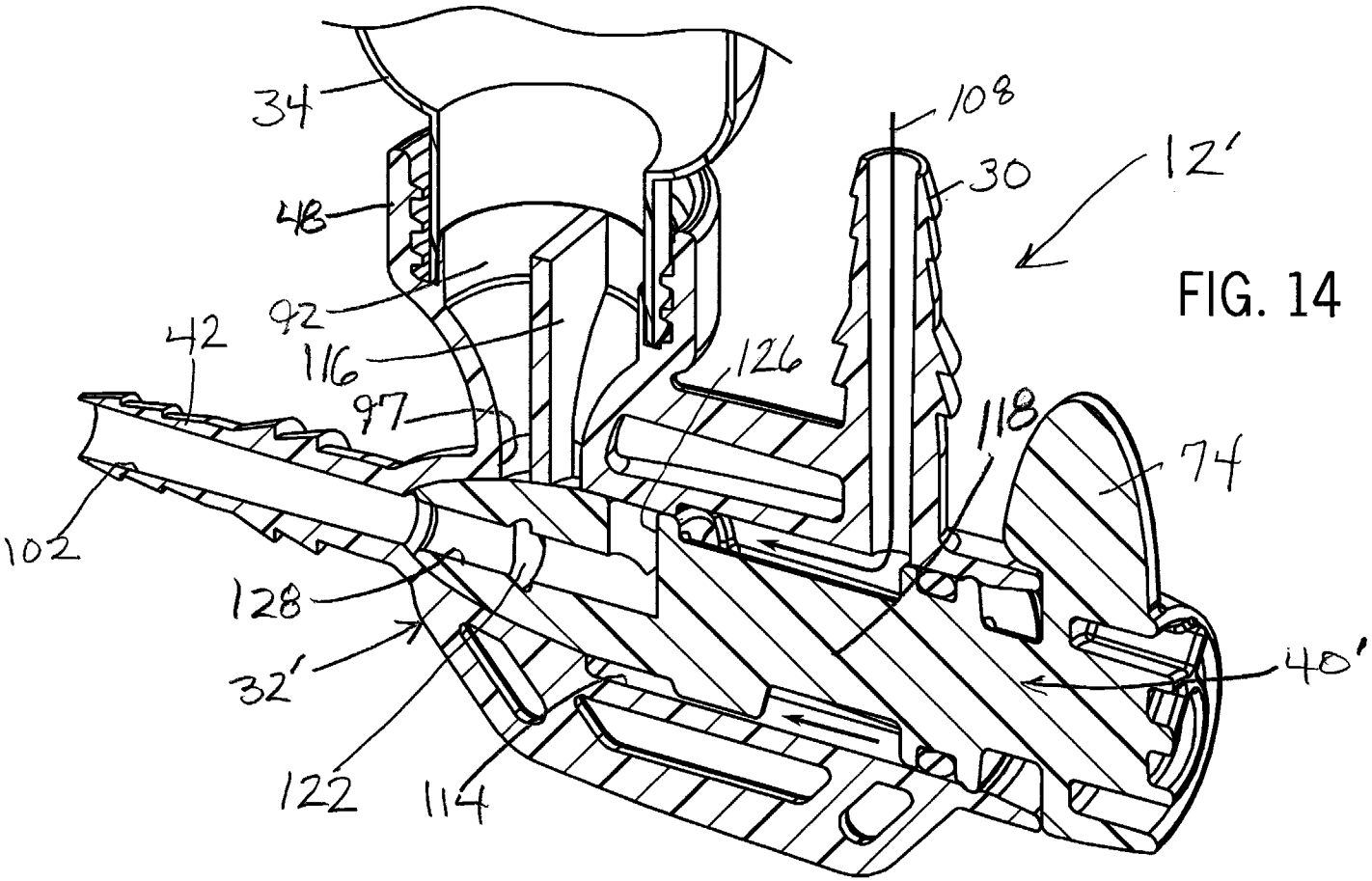
FIG. 14 is a longitudinal view of the control valve assembly of FIG. 11 in a no flow condition.
Figure 15:
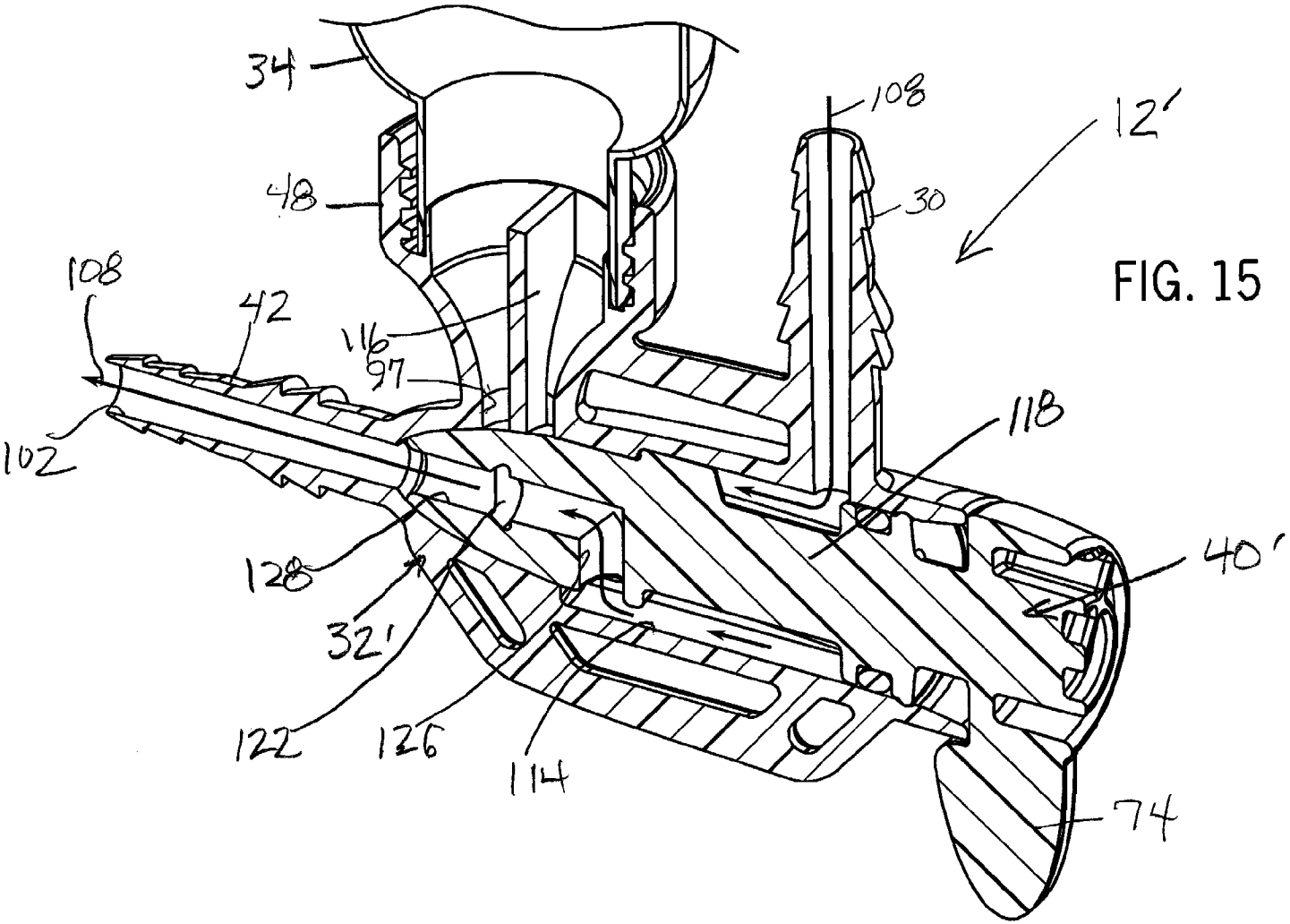
FIG. 15 is a longitudinal sectional view of the control valve assembly of FIG. 11 in a single flow condition allowing only liquid flow.
Figure 16:
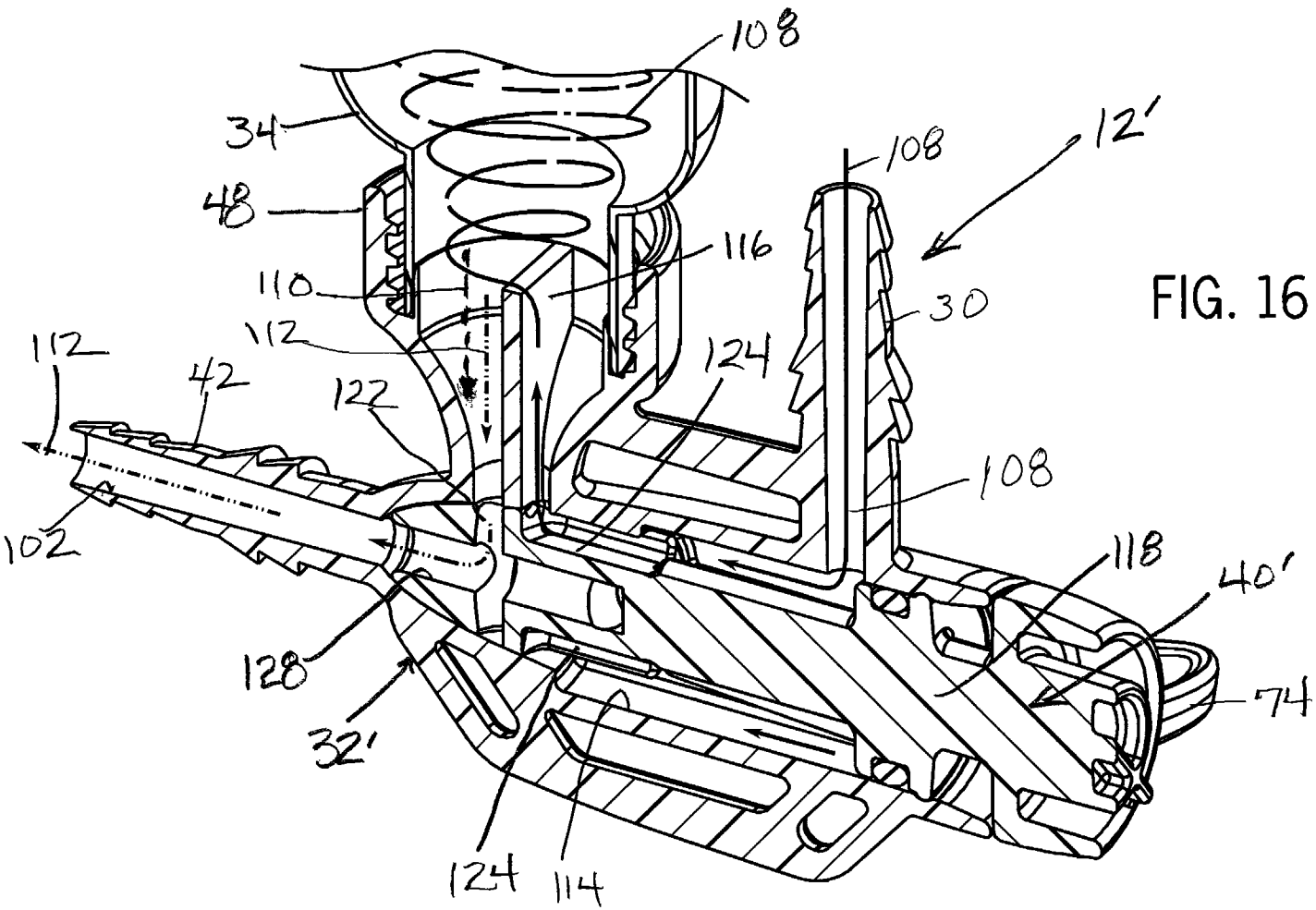
FIG. 16 is a longitudinal sectional view of FIG. 11 in a mixed flow condition allowing a mixture of liquid and additive flow.

Control valve assembly 12' includes a valve body 32' in which a valve core 40' is rotatably mounted. As seen best in FIG. 11, valve body 32' is formed with a lower belly portion 114 that facilitates a directed flow of water or liquid from the hydration bladder 14 through the control valve assembly 12'. Referring to FIGS. 14-16, reservoir receiver 48 of valve body 32' is provided internally with a vertically extending flow divider 116 which extends from the base of opening 97 up to the sealing ring 92.

Turning to FIGS. 12-16, the valve port 40' has an elongated splined spool portion 118 and a bulbous front end 120 formed therethrough with a valve core port 122 that communicates via a recess 123 with a depression 124. Recesses 123 and depressions 124 are provided on each side of the front end 120. Front end 120 is further formed with another valve core port 126 which is spaced from the depression 124. Valve core ports 122 and 126 are in communication with an internal chamber 128 which extends out of the front end 120 of the control core 40', and communicates with outlet port 102 and valve core 40' mounted inside valve body 32'. Valve core ports 122 and 124, recesses 123, depressions 124 and chamber 128 define liquid passageways for conducting liquid flow through the control valve assembly 12'.

In operation of the control valve assembly 12', the valve core 40' is rotatably mounted within valve body 32' in a no flow condition when the handle 74 is turned to the upwardly extending position as shown in FIG. 14. In the no flow condition, liquid flow from the bladder 14, as represented by solid line 108, may be drawn through inlet port 30 for flow around the spool portion 118, but the rotational position of the valve core 40' prevents any liquid flow 108 from entering valve core port 126, chamber 128 and outlet port 102 as well as opening 97.

When the handle 74 of valve core 40' is rotated to the downwardly extending orientation, as shown in FIG. 15, a single flow condition is established in which liquid flow 108 from the bladder 14 is drawn through inlet port 30, flows around spool portion 118, and is allowed to flow through valve port 126 into chamber 128 and out of outlet port 102. The rotational position of the valve core 40' prevents any liquid flow 108 from entering the opening 97 leading into the reservoir 34 filled with additive 36 or 38.

When the valve core 40' is further rotated to the laterally extending orientation, as shown in FIG. 16, a mixed flow condition is defined. In the mixed flow condition, liquid flow 108 from bladder 14 drawn through the inlet port 30 flows around spool portion 118 and is led into depressions 124 and opening 97 at the bottom of reservoir receiver 48. The liquid flow 108 is then directed along one side of the flow divider 116 so that if forcefully circulates and mixes with the additive 36 or 38 in the reservoir 34 as represented by the dotted line 110. Flow divider 116 and narrowed portion 94 act as a flow directing structure for directing liquid flow from bladder 14 into reservoir 34 to facilitate circulation of liquid and additive in the reservoir 34. The liquid and additive mixture represented by the dotted line 112 flows down the other side of flow divider 116 and exits out chamber 128 and outlet port 102. As the additive 36 or 38 is used, liquid flow 108 continues to replenish the empty space in the reservoir 34 vacated by the additive 36 or 38.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Various alternatives and embodiments are contemplated as being with in the scope of the following claims, particularly pointing out and distinctly claiming the subject matter regarded as the invention.

What is claimed is:

1. A personal hydration system comprising:

a hydration bladder for holding a liquid;

a control valve assembly including a valve body provided with a first inlet port in communication with the liquid in the hydration bladder, a second inlet port and an outlet port for dispensing, at least the liquid from the hydration bladder therefrom;

the control valve having a reservoir holding an additive and being mounted to the second inlet port of the valve body such that the additive is in communication with the second inlet port; and the control valve assembly also including a valve core mounted within the valve body to establish a mixed flow condition of the liquid and the additive, whereby the valve body and the valve core cooperatively define a liquid circulation arrangement with flow directing structures to divert a first portion of the liquid from the hydration bladder into the reservoir to mix with the additive and direct a second portion of the liquid to the outlet port, wherein the first portion of the liquid and the additive form a mixture, the valve body receives the mixture and provides the mixture to the outlet port.

2. A personal hydration system comprising:

a hydration bladder for holding a liquid;

a control valve assembly including a valve body provided with a first inlet port, a second inlet port and an outlet port provided with a delivery hose for dispensing at least the liquid from the hydration bladder therefrom;

the control valve assembly having a non-collapsible reservoir holding an additive and being directly mounted via a rigid connection to the second inlet port of the valve body such that the additive is in communication with the second inlet port and the reservoir extends from the valve body at a substantially 90° orientation thereto; and a supply hose connected between the hydration bladder and the first inlet port of the valve body such that the liquid is in communication with the first inlet port, the control valve assembly also including a valve core rotatably mounted within the valve body to establish at least either a single flow condition of the liquid or a mixed flow condition of the liquid and the additive, whereby, in the mixed flow condition, liquid from the hydration bladder flows freely through the valve core, the valve body being provided with flow directing structure that diverts a first portion of the liquid into the reservoir to mix with the additive and directs a second portion of the liquid to the outlet port, the valve body receives the mixture of the first portion of the liquid and the additive from the reservoir and provides the mixture to the outlet.

3. The personal hydration system of claim 2, wherein the valve body is formed with a reservoir receiver that defines a second inlet port and the rigid connection to which the non-collapsible reservoir is mounted, wherein in the mixed flow condition, the valve body diverts the first portion of the liquid out of the valve body into the reservoir and receives the mixture from reservoir into the valve body.

4. The personal hydration system of claim 2, wherein the mixture of the first portion of the liquid and the additive received in the valve body mixes with the second portion of the liquid, and the valve body provides the combined first portion, second portion, and additive to the outlet port and the delivery hose.

5. The personal hydration system of claim 2, wherein the valve body includes retaining structure adapted to be used in fastening the control valve assembly to supporting straps for the hydration bladder.

6. The personal hydration system of claim 2, wherein the valve core is provided with liquid passageways which permit liquid flow from the hydration bladder to freely flow into the second inlet port and the reservoir in the mixed flow condition.

7. The personal hydration system of claim 2, wherein the valve core is mourned in the valve body so as to define a recess extending between an internal wall of the valve body and an outer surface of the valve core for receiving liquid from the hydration bladder.

8. The personal hydration system of claim 2, wherein the rigid connection is provided with scaling structure for enabling a leak-free attachment of the reservoir on the valve body.

9. A control valve assembly adapted for use with a personal hydration system having, a hydration bladder holding a liquid and provided with a supply hose in communication with the liquid, the control valve assembly comprising:

a tubular valve body having a first inlet port adapted to be connected to the supply hose, a second inlet port extending from the valve body, the second inlet port being directly and rigidly mounted to a non-collapsible reservoir holding an additive thereon such that the additive, as well as liquid from the hydration bladder, is permitted to flow through the second inlet port, and an outlet port adapted to be connected to a delivery hose for dispensing at least liquid from the hydration bladder; and a valve core movably mounted in the valve body and having liquid passageways cooperable with the first and second inlet ports and the outlet port to establish at least a single flow condition of the liquid and a mixed flow condition of the liquid and the additive deliverable to the outlet port and the delivery hose, wherein, in the mixed flow condition, the valve core enables liquid from the hydration bladder to flow freely through the first and second inlet ports and be admitted and circulated through the reservoir to produce a mixture of liquid and additive deliverable through the second inlet port to the outlet port and the delivery hose, and the valve body is provided with flow directing structure for directing a first portion of liquid flow from the hydration bladder into the reservoir to facilitate circulation of the first portion of liquid and additive in the reservoir and directing a second portion of liquid flow from the hydration bladder to the outlet port, the valve body receives the mixture of the first portion of the liquid and the additive and provides the mixture to the outlet port.

10. The control valve assembly of claim 9, wherein, in the mixed flow condition, the non-collapsible reservoir defines an interior space which is continuously replenished by liquid flow from the hydration bladder.

11. The control valve assembly of claim 9, wherein the valve body is formed with a reservoir receiver that defines the second inlet port and the rigid connection to which the non-collapsible reservoir is mounted.

12. The control valve assembly of claim 9, wherein the non-collapsible reservoir is removably connected directly to the valve body to enable cleansing and refilling of the reservoir with a desired additive.

13. The control valve assembly of claim 9, wherein the valve body includes retaining structure adapted to be used in fastening the control valve assembly to supporting straps for the hydration bladder.

14. The control valve assembly of claim 9, wherein the valve core is mounted in the valve body so as to define a recess extending between an internal wall of the valve body and an outer surface of the valve core for receiving liquid from the hydration bladder.

15. The control valve assembly of claim 9, wherein the rigid connection is provided with a sealing structure for enabling, a leak-free attachment of the reservoir on the valve body.

16. A kit adapted to be used to control flow in a personal hydration system having a hydration bladder filled with liquid and supported by straps upon a body of a user and provided with a supply hose in communication with the liquid, the kit comprising:

a non-collapsible reservoir for holding an additive therein;

a control valve assembly including a tubular valve body having a first inlet port adapted to be connected to the supply hose, a second inlet port defining a flow connection for directly and rigidly mounting the reservoir thereto such that the additive and the liquid from the hydration bladder is selectively permitted to flow into and out of the second inlet port, and an outlet port in communication with the first and second inlet ports adapted to be connected to a delivery hose for dispensing, at least the liquid from the hydration bladder, the control valve assembly also including a valve core movably mounted within the valve body and having liquid passageways cooperable with the first and second inlet ports and the outlet port, the valve core being adapted to establish at least a single flow condition of the fluid and a mixed flow condition of the liquid and the additive, wherein in the mixed flow condition the valve core directs a first portion of the liquid from the hydration reservoir through the second inlet port into the reservoir, receives the additive and the first portion of the liquid, provides the additive and the first portion of the liquid to the outlet port, and the valve core directs a second portion of the liquid to the outlet port; and an attachment arrangement adapted to connect at least one of the control valve assembly and the reservoir to the straps supporting the hydration bladder.

17. The kit of claim 16, wherein the valve body includes a first retaining element located between the first and second inlet ports and engageable with the attachment arrangement.

18. The kit of claim 17, wherein the valve body includes a second retaining element spaced from the first retaining element and engageable with the attachment arrangement.

19. A personal hydration system comprising:

a liquid supply means for holding a liquid;

a control valve means including a valve body means provided with a first inlet means in communication with the liquid in the liquid supply means, a second inlet means, and an outlet means for dispensing at least the liquid from the liquid supply means;

the control valve means having to reservoir means for holding an additive, the reservoir means being mounted to the second inlet means such that the additive is in communication with the second inlet means; and the control valve means also including a valve core means mounted within the valve body means for establishing, at least either a single flow condition of the liquid or a mixed flow condition of the liquid and the additive;

whereby the valve body means and the valve core means cooperatively define flow directing means for directing a first portion of flow from the supply means into the reservoir means to permit circulation and form a mixture of the liquid and the additive in the reservoir means and for directing a second portion of flow horn the supply means to the outlet means, the valve body means receives the mixture from the reservoir means and provides the mixture to the outlet means.

* * * * *